US010428719B2

(12) United States Patent
Lee et al.

(10) Patent No.: US 10,428,719 B2
(45) Date of Patent: Oct. 1, 2019

(54) EXHAUST SIDE BLOCK INSERT, CYLINDER BLOCK ASSEMBLY INCLUDING THE SAME, AND HEAT MANAGEMENT SYSTEM OF ENGINE INCLUDING THE SAME

(71) Applicants: Hyundai Motor Company, Seoul (KR); Kia Motors Corporation, Seoul (KR)

(72) Inventors: Byung-Soo Lee, Hwaseong-si (KR); Bong-Sang Lee, Seongnam-si (KR); Woo-Tae Kim, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/386,852

(22) Filed: Dec. 21, 2016

(65) Prior Publication Data

US 2017/0370271 A1 Dec. 28, 2017

(30) Foreign Application Priority Data

Jun. 22, 2016 (KR) ..... 10-2016-0077951

(51) Int. Cl.
*F01P 3/02* (2006.01)
*F01P 3/20* (2006.01)
(Continued)

(52) U.S. Cl.
CPC ..... *F01P 3/02* (2013.01); *F01M 13/00* (2013.01); *F01P 3/20* (2013.01); *F01P 5/10* (2013.01);
(Continued)

(58) Field of Classification Search
CPC ..... F01P 3/02; F01P 5/10; F01P 7/14; F01P 11/04; F01P 3/20; F01P 2003/021;
(Continued)

(56) References Cited

U.S. PATENT DOCUMENTS

2010/0031902 A1* 2/2010 Alyanak ..... F02F 1/14 123/41.44

FOREIGN PATENT DOCUMENTS

JP 6-58123 U 8/1994
JP 8-296494 A 11/1996
(Continued)

*Primary Examiner* — Jacob M Amick
*Assistant Examiner* — Charles Brauch
(74) *Attorney, Agent, or Firm* — Morgan, Lewis & Bockius LLP

(57) ABSTRACT

A cylinder block assembly may include a cylinder block, a cylinder body disposed in the cylinder block, with a plurality of cylinder bores formed in the cylinder body, a fluid jacket, which is formed between an inner circumferential surface of the cylinder block and an outer circumferential surface of the cylinder body, and through which coolant flows, and a block insert disposed in the water jacket and configured to guide a flow of coolant, wherein the cylinder block may include a second block coolant outlet, which is formed at a second side in a surface of an exhaust side of the cylinder block, and through which the coolant in the water jacket is discharged, and wherein the exhaust side may include a side at which combustion gas is exhausted out of the cylinder body.

16 Claims, 9 Drawing Sheets

(51) Int. Cl.

| | |
|---|---|
| ***F01P 5/10*** | (2006.01) |
| ***F01P 7/14*** | (2006.01) |
| ***F01P 11/04*** | (2006.01) |
| ***F02F 1/14*** | (2006.01) |
| ***F02F 1/38*** | (2006.01) |
| ***F01M 13/00*** | (2006.01) |
| ***F02F 1/24*** | (2006.01) |
| ***F02F 1/40*** | (2006.01) |
| ***F02F 1/36*** | (2006.01) |

(52) U.S. Cl.
CPC ..... *F01P 7/14* (2013.01); *F01P 11/04* (2013.01); *F02F 1/14* (2013.01); *F02F 1/24* (2013.01); *F02F 1/38* (2013.01); *F01P 2003/021* (2013.01); *F01P 2003/024* (2013.01); *F01P 2003/027* (2013.01); *F01P 2007/146* (2013.01); *F01P 2060/18* (2013.01); *F02F 1/36* (2013.01); *F02F 1/40* (2013.01)

(58) Field of Classification Search
CPC ..... F01P 2007/146; F01P 2060/18; F01P 2003/027; F02F 1/14; F02F 1/38
See application file for complete search history.

(56) References Cited

FOREIGN PATENT DOCUMENTS

| | | | | |
|---|---|---|---|---|
| JP | 3584860 | B2 | 11/2004 | |
| JP | 4098712 | B2 | 6/2008 | |
| JP | 2010-203244 | A | 9/2010 | |
| JP | 2012-047087 | A | 3/2012 | |
| JP | 2012-167552 | A | 9/2012 | |
| JP | WO 2014129139 | A1 * | 8/2014 | ..... F01P 3/02 |
| KR | 10-2013-0053311 | A | 5/2013 | |
| KR | 10-2017-0051678 | A | 5/2017 | |

* cited by examiner

EXHAUST SIDE BLOCK INSERT, CYLINDER BLOCK ASSEMBLY INCLUDING THE SAME, AND HEAT MANAGEMENT SYSTEM OF ENGINE INCLUDING THE SAME

CROSS-REFERENCE TO RELATED APPLICATIONS

The present application claims priority to Korean Patent Application No. 10-2016-0077951, filed on Jun. 22, 2016, the entire contents of which is incorporated herein for all purposes by this reference.

BACKGROUND OF THE INVENTION

Field of the Invention

Exemplary embodiments of the present invention relate to an exhaust side block insert, a cylinder block assembly including the same, and a heat management system of an engine including the same; and, particularly, to an exhaust side block insert which is configured such that an exhaust side upper portion of a cylinder block can always be cooled, thus preventing knocking and a crack in the cylinder block, and to a cylinder block assembly including the same, and a heat management system of an engine including the same.

Description of Related Art

In general, an engine for a vehicle includes a cylinder block and a cylinder head. The cylinder block has a plurality of cylinder bores in which respective pistons can reciprocate. The cylinder head is mounted on an upper portion of the cylinder block, forms combustion chambers along with the pistons, and includes a plurality of intake/exhaust ports provided for installation of various intake/exhaust valves.

The engine having the above-mentioned structure includes, in the cylinder block and the cylinder head, a water jacket provided for the flow of coolant around the periphery of each of the cylinder bores, the combustions and the intake/exhaust portions. The water jacket guides the flow of coolant discharged from the water pump, to the entire region in the cylinder block and the cylinder head so that the working temperature of the engine can be maintained within a normal temperature range during the entire operation period of the engine.

That is, the water jacket functions as a flow passage of coolant provided for preventing critical components such as the cylinder block, the cylinder head and the pistons from being thermally damaged by high-temperature (approximately, 2500° C.) heat generated during a combustion process of a fuel-air mixture in the combustion chambers.

In a conventional engine, the temperature of coolant in the cylinder head and the cylinder block is controlled by a single coolant temperature control apparatus disposed on a coolant inlet or outlet of the engine. Thereby, coolant in the cylinder head and the cylinder block is maintained at similar temperatures. Recently, a variable separation cooling technique for separately controlling the temperatures of coolant for the cylinder head and the cylinder block was proposed so as to improve the fuel efficiency and performance of the engine.

FIG. 1 is a view for explaining problems with the conventional art. Hereinafter, a water jacket for a cylinder head and a cylinder block according to the conventional art using the variable separation cooling technique will be described in detail with reference to FIG. 1. As shown in FIG. 1, in the conventional variable separation cooling technique, the water jacket is divided, and the cylinder head and the cylinder block are separately cooled. In this regard, coolant of the cylinder head that is drawn from the water pump forms parallel flows, and coolant in the cylinder block forms a U-turn flow. The U-turn flow of coolant is drawn into the cylinder head, and then is discharged out of the engine, along with the parallel flows of coolant.

However, the conventional technique having the above-mentioned configuration cannot sufficiently reduce the temperature of an upper portion (particularly, an exhaust side upper portion) of the cylinder block, thus causing problems such as knocking and a crack in the cylinder block.

Furthermore, the temperatures and flow rates of coolant for cooling the respective cylinders may differ from each other. Therefore, there is a problem in that efficiency of cooling the engine is reduced.

In addition, even when there is a need for interrupting an operation of cooling a lower portion of the cylinder block to achieve rapid warm up during a cold start, the cooling for the lower portion of the cylinder body cannot be separately controlled. Thereby, there are problems in that the performance in a cold start is deteriorated, and the fuel efficiency is reduced.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an exhaust side block insert which is provided for separately cooling a cylinder head and a cylinder block, and particularly, separately cooling an exhaust side upper portion of the cylinder block and the other portions thereof, and a cylinder block assembly including the same, and a heat management system of an engine including the same.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, there is provided a cylinder block assembly including: a cylinder block (100); a cylinder body (200) disposed in the cylinder block (100), with a plurality of cylinder bores (210) formed in the cylinder body (200); a water jacket (300), which is formed between an inner circumferential surface of the cylinder block (100) and an outer circumferential surface of the cylinder body (200), and through which coolant flows; and a block insert (400) disposed in the water jacket (300) and configured to guide a flow of coolant, wherein the cylinder block (100) includes a second block coolant outlet (130), which is formed at a second side in a surface of an exhaust side of the cylinder block (100), and through which the coolant in the water jacket (300) is discharged, and wherein the exhaust side is a side at which combustion gas is exhausted out of the cylinder body (200).

The cylinder block (100) may include a block coolant inlet (110) which is formed at a first side in a surface of an intake side of the cylinder block (100), and into which coolant is drawn from a water pump (20), the block coolant inlet (110) being configured to supply the drawn coolant into the water jacket (300), wherein the intake side may be a side at which a mixture of fuel and air is drawn into the cylinder body (200).

The cylinder block (100) may include a first block coolant outlet (120), which is formed in a second side surface of the cylinder block (100), and through which the coolant in the water jacket (300) is discharged.

The cylinder block (100) may include a block gallery (140) diverging from the block coolant inlet (110) and configured to supply, into a cylinder head (30), coolant drawn into the block coolant inlet (110), the block gallery (140) making a plurality of flows of supplied coolant parallel to each other.

The water jacket (300) may include: an intake side water jacket (310) including, of flow passages formed from the block coolant inlet (110) to the first block coolant outlet (120), a flow passage formed in the intake side; and an exhaust side water jacket (320) including, of the flow passages formed from the block coolant inlet (110) to the first block coolant outlet (120), a flow passage formed in the exhaust side.

The exhaust side water jacket (320) may include: an exhaust side upper flow passage (321) provided as a flow passage formed at the exhaust side, and communicating with the second block coolant outlet (130); and an exhaust side lower flow passage (322) provided as a flow passage formed at the exhaust side, and communicating with the first block coolant outlet (120).

The block insert (400) may include: an intake side block insert (410) disposed in the intake side water jacket (310) and configured to increase a flow rate of the exhaust side water jacket (320); and an exhaust side block insert (420) disposed in the exhaust side water jacket (320) and configured to divide the exhaust side water jacket (320) into the exhaust side upper flow passage (321) and the exhaust side lower flow passage (322).

The intake side block insert (410) may include: a plurality of flow resistance portions (411) formed such that inner surfaces thereof come into contact with respective siamese portions (220) of the cylinder body (200); insert supports (412) protruding upward from upper ends of the respective flow resistance portions (411); and a bridge (413) coupling the flow resistance portions (411) to each other.

The exhaust side block insert (420) may include: a body part (421) coming into contact with an outer surface of the exhaust side water jacket (320); and a gasket (422) protruding perpendicularly from an inner surface of the body part (421) and coming into an inner surface of the exhaust side water jacket (320) so that the exhaust side water jacket (320) is partitioned into the exhaust side upper flow passage (321) and the exhaust side lower flow passage (322) by the gasket (422).

The body part (421) may include a through hole (421-1) formed above the gasket (422) and communicating with the second block coolant outlet (130).

In accordance with another embodiment of the present invention, there is provided an exhaust side block insert (420) installed in an exhaust side water jacket (320) of a water jacket (300) formed between a cylinder block (100) and a cylinder body (200), the exhaust side block insert (420) including: a body part (421) coming into contact with an outer surface of the exhaust side water jacket (320); and a gasket (422) protruding perpendicularly from an inner surface of the body part (421) and coming into contact with an inner surface of the exhaust side water jacket (320) so that the exhaust side water jacket (320) is partitioned into an exhaust side upper flow passage (321) and an exhaust side lower flow passage (322) by the gasket (422).

The body part (421) may include a through hole (421-1) formed above the gasket (422) and communicating with a second block coolant outlet (130) formed in an upper end of a second side of the cylinder block (100).

In accordance with another embodiment of the present invention, there is provided a heat management system of an engine, including: the cylinder block assembly (10); a water pump (20) configured to supply coolant to a block coolant inlet (110) of the cylinder block assembly (10); a cylinder head (30) mounted on an upper end of the cylinder block assembly (10) and configured such that coolant that has passed through the block gallery (140) is drawn into the cylinder head (30), the cylinder head (30) including a cylinder head coolant outlet (31) through which the coolant is discharged out of the cylinder head (30); and a flow rate control valve (40) communicating at a first side thereof with the cylinder head coolant outlet (31) and the first block coolant outlet (120), and configured to individually interrupt the communication with the first block coolant outlet (120).

The heat management system may further include a radiator (50) and a heater core (60) that fluidically-communicate with a second side of the flow rate control valve (40), wherein the communication with each of the radiator (50) and the heater core (60) may be individually interrupted by the flow rate control valve (40).

The heat management system may further include an accessory unit (70) communicating with the second block coolant outlet (130).

The water pump (20) may fluidically-communicate with the radiator (50), the heater core (60) and the accessory unit (70). The coolant discharged from the radiator (50), the heater core (60) or the accessory unit (70) may be drawn into the water pump (20) again.

The cylinder head (30) may include: a plurality of cylinder head coolant inlets (32) into which coolant is drawn from the block gallery (140); a cylinder head water jacket (33) formed such that a plurality of flows of coolant drawn through the cylinder head coolant inlets (32) form cross flows parallel to each other and cool respective combustion chambers; and a cylinder head coolant outlet (31) through which coolant that has passed through the cylinder head water jacket (33) is discharged.

The accessory unit (70) may include an assembly including an Exhaust Gas Recirculation (EGR) cooler (71) and an Automatic Transmission Fluid (ATF) warmer (72) that are disposed in series or parallel to each other.

While the coolant is warmed up, the flow rate control valve (40) may interrupt the communication with the first block coolant outlet (120).

While the coolant is cooled, the flow rate control valve (40) may open the communication with the first block coolant outlet (120) and the communication with the radiator (50).

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
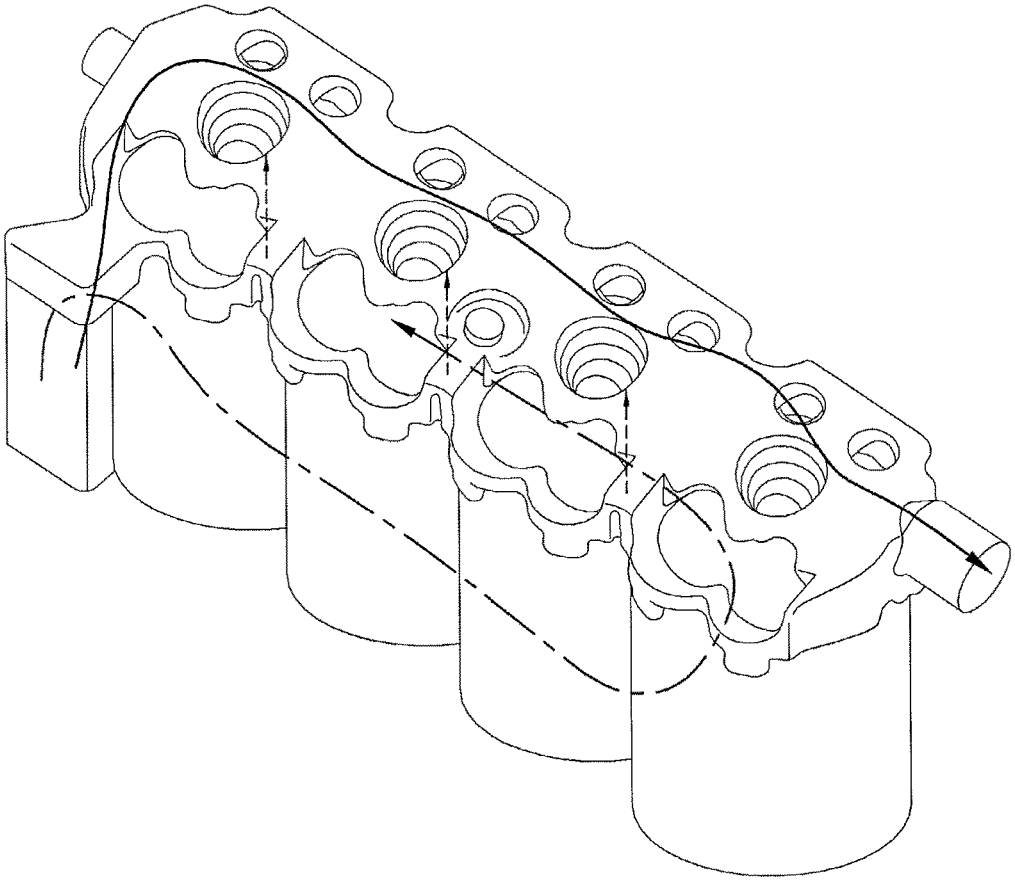
FIG. 1 (Related art)
FIG. 1 is a view describing problems with a conventional art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will be described below in more detail with reference to the accompanying drawings to be easily realized by those skilled in the art.

The present invention may, however, be embodied in different forms and should not be construed as limited to the embodiments set forth herein. In certain embodiments, irrelevant to the present invention may be omitted to avoid obscuring appreciation of the disclosure. Throughout the disclosure, like reference numerals refer to like parts throughout the various figures and embodiments of the present invention.

The drawings are not necessarily to scale and in some instances, proportions may have been exaggerated in order to clearly illustrate various layers and regions of the embodiments. It will be understood that when an element such as a layer, a film, a region, or a plate is referred to as being "above" another element, it can be "immediately above" the other element or intervening elements may also be present.

In contrast, when an element is referred to as being "immediately above" another element, there are no intervening elements present. In addition, it will be understood that when an element is referred to as being "entirely" formed on another element, it can be formed on the entire surface (or whole surface) of the other element or cannot be formed at a portion of the edge thereof.

Hereinafter, an embodiment of the present invention will be described in detail with reference to the attached drawings.

Figure 2:
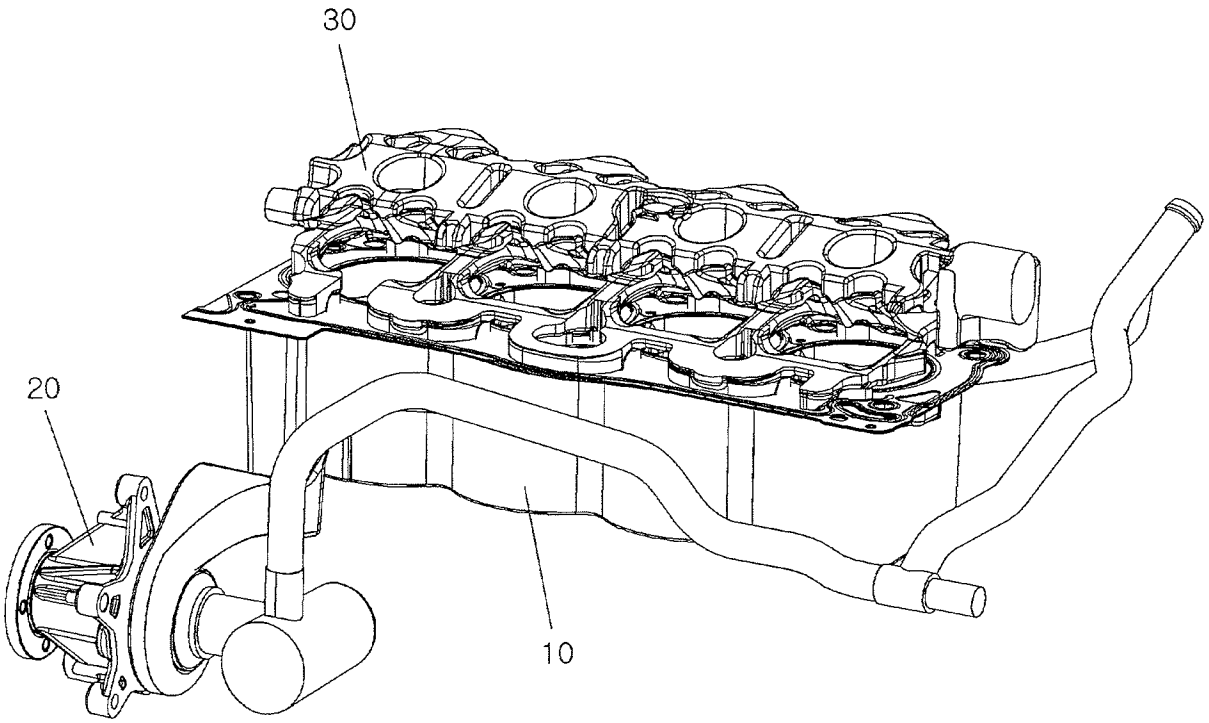
FIG. 2 is a front perspective view of a cylinder block assembly according to an exemplary embodiment of the present invention.
Figure 3:
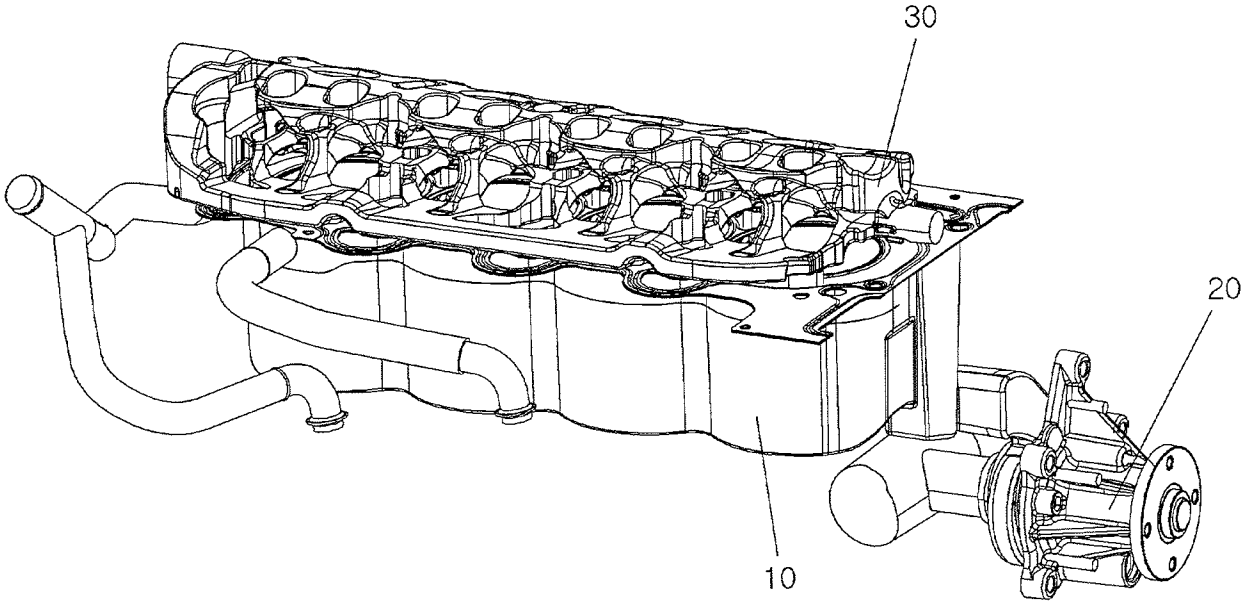
FIG. 3 is a rear perspective view of the cylinder block assembly according to an exemplary embodiment of the present invention.
Figure 4:
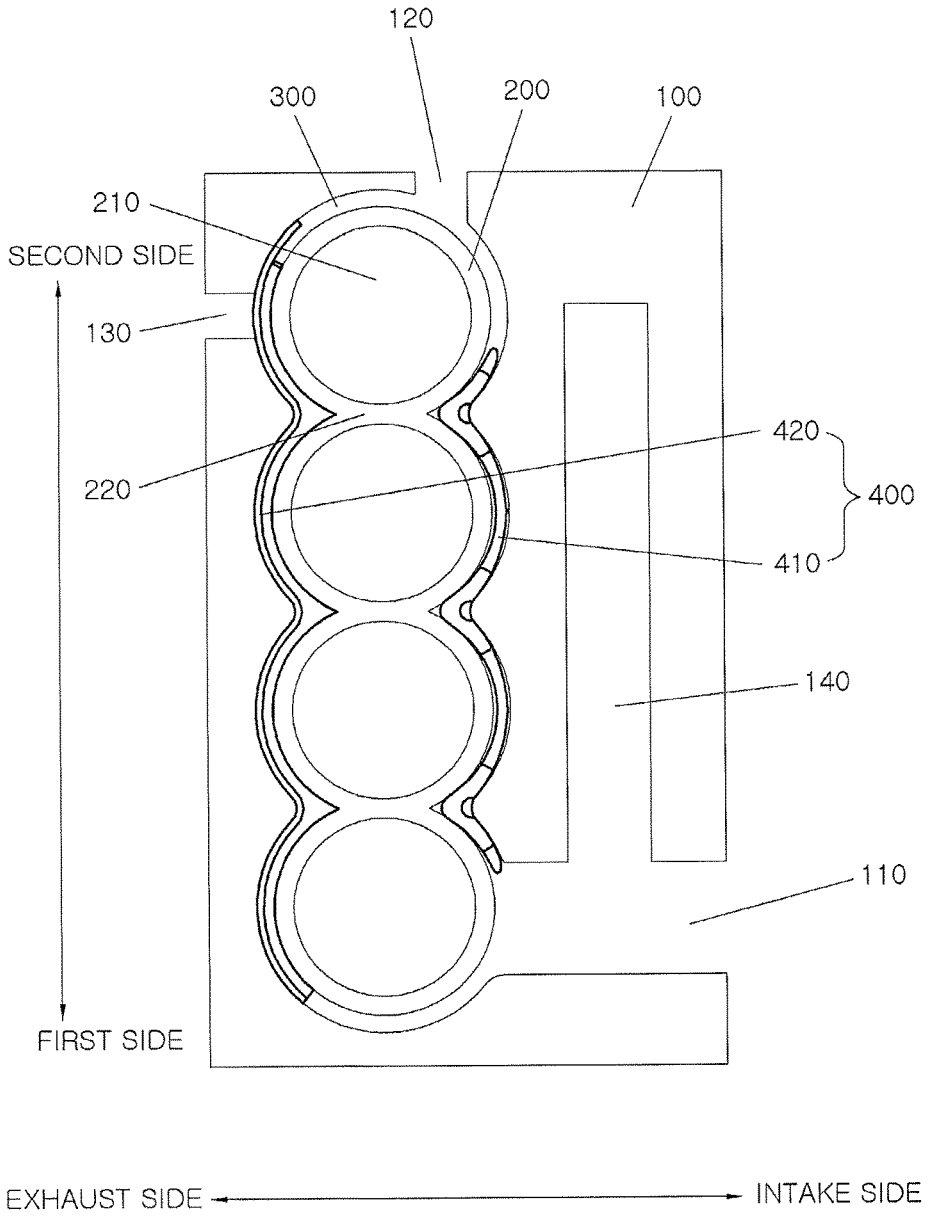
FIG. 4 and FIG. 5 are plan views of the cylinder block assembly according to an exemplary embodiment of the present invention.
Figure 5:
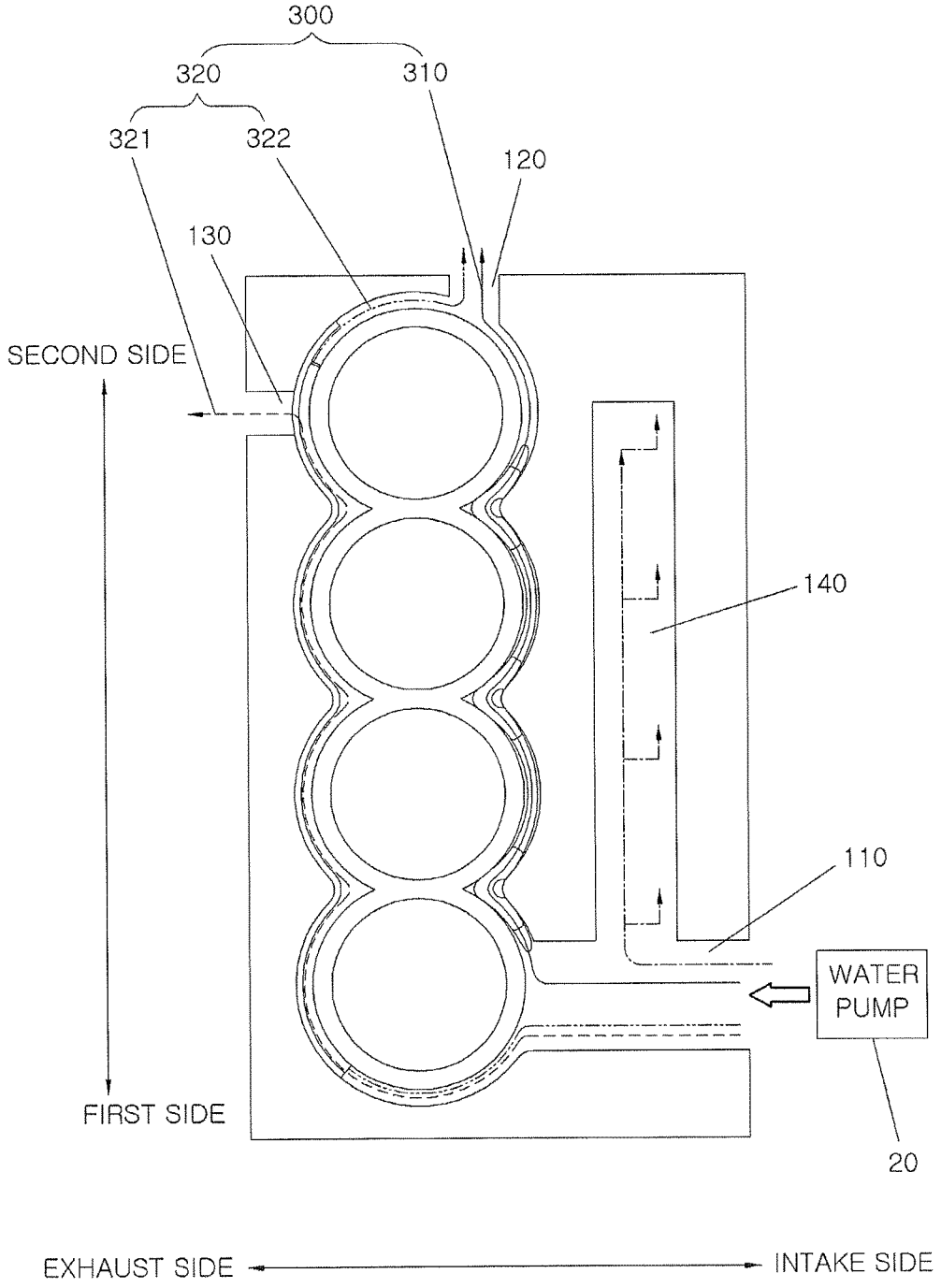
Figure 6:
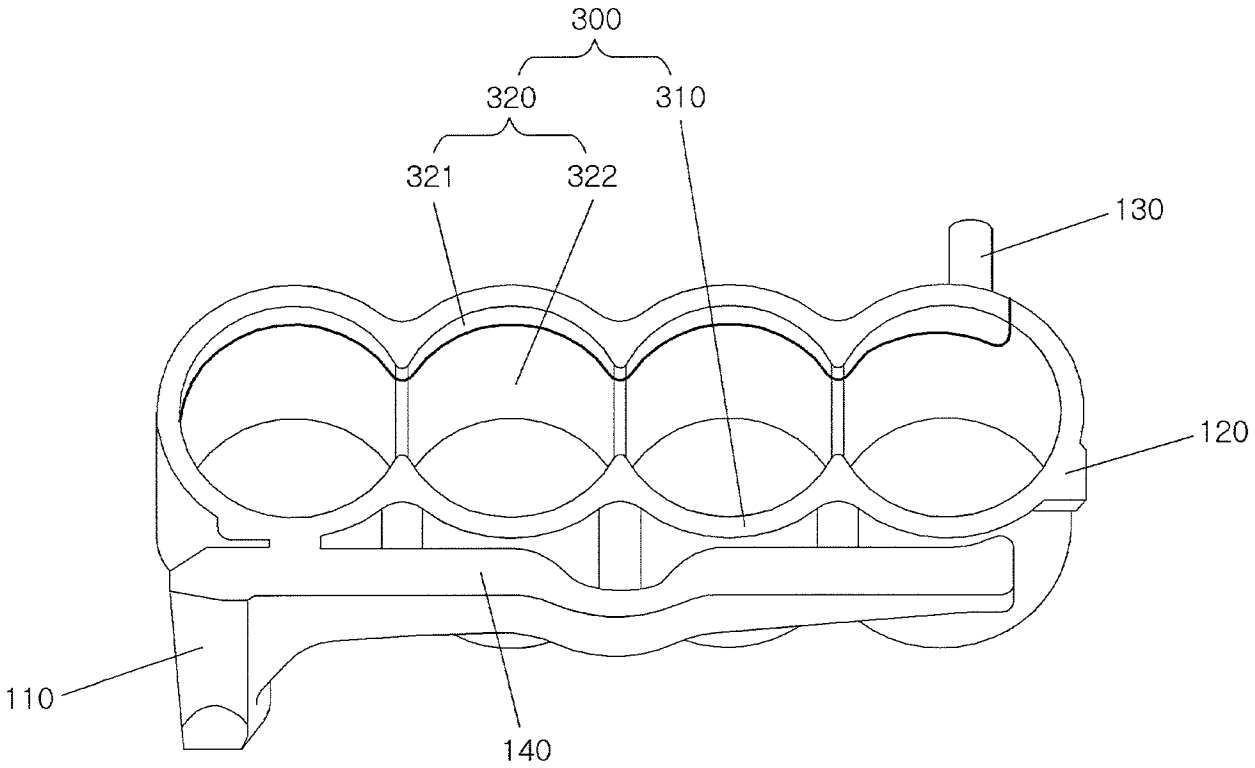
FIG. 6 is a perspective view of a water, jacket according to an exemplary embodiment of the present invention.
Figure 7:
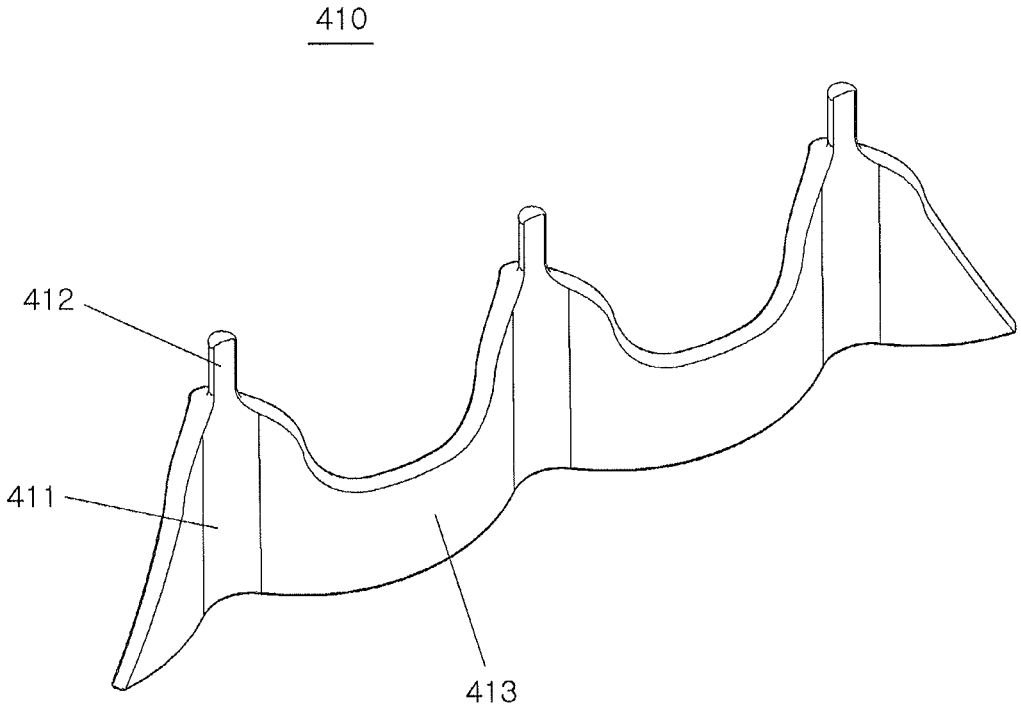
FIG. 7 is a perspective view of an intake side block insert according to an exemplary embodiment of the present invention.

FIG. 2 is a front perspective view of a cylinder block assembly according to an exemplary embodiment of the present invention, and FIG. 3 is a rear perspective view of the cylinder block assembly according to an exemplary embodiment of the present invention. FIGS. 4 and 5 are plan views of the cylinder block assembly according to an exemplary embodiment of the present invention. FIG. 6 is a perspective view of a water jacket according to an exemplary embodiment of the present invention, and FIG. 7 is a perspective view of an intake side block insert according to an exemplary embodiment of the present invention. Referring to FIGS. 2 to 7, the cylinder block assembly according to an exemplary embodiment of the present invention includes a cylinder block 100, a cylinder body 200, a water jacket 300 and a block insert 400.

The cylinder block 100 includes a block coolant inlet 110, a first block coolant outlet 120, a second block coolant outlet 130, and a block gallery 140. The block coolant inlet 110 is formed at a first side in an intake side surface of the cylinder block 100.

The term "intake side" refers to a side at which a mixture of fuel and air is drawn into the cylinder body 200. The term "first side" may refer to a front side of the vehicle, but it may not be limited to this, and may be set in different ways depending on the intention of a designer.

Coolant is drawn from the water pump 20 into the block coolant inlet 110. The coolant drawn into the block coolant inlet 110 is supplied into the water jacket 300 through the block coolant inlet 110.

The first block coolant outlet 120 is formed in a second side surface of the cylinder block 100. The term "second side" may refer to a rear side of the vehicle, but it may not be limited to this, and may be set in different ways depending on the intention of a designer. Coolant that is in the water jacket 300 is discharged out of the cylinder block 100 through the first block coolant outlet 120. The first block coolant outlet 120 fluidically-communicates with a flow rate control valve 40 which will be described later herein. During a cold start, to achieve rapid warm up, the communication with the first block coolant outlet 120 may be interrupted by the flow rate control valve 40.

The second block coolant outlet 130 is formed at a second side in an exhaust side surface of the cylinder block 100. The term "exhaust side" refers to a side at which combustion gas is discharged out of the cylinder body 200. Coolant is discharged out of the water jacket 300 through the second block coolant outlet 130. The second block coolant outlet 130 is formed in an exhaust side upper portion of the cylinder block 100 and always fluidically-communicates with an accessory unit 70 which will be described later herein. Coolant continuously cools the exhaust side upper portion of the cylinder block, thus preventing knocking or a crack in the cylinder block. The second block coolant outlet 130 will be described in more detail later herein.

The block gallery 140 diverges from the block coolant inlet 110 and functions to supply, into the cylinder head 30, some of coolant drawn into the block coolant inlet 110. Furthermore, the block gallery 140 makes a plurality of flows of coolant supplied into the cylinder head 30 be parallel to each other and thus is configured to induce cross flows in the cylinder head 30. The cross flows are a plurality of flows formed in a direction perpendicular to the parallel flows of FIG. 1 and uniformly cool the respective cylinders, thus enhancing the efficiency of cooling the engine.

The cylinder body 200 is disposed in the cylinder block 100, and a plurality of cylinder bores 210 are formed in the cylinder body 200. A siamese portion 220 is formed between the cylinder bores 210. Combustion occurs in each cylinder bore 210, whereby high-temperature heat is generated the cylinder body 200. To cool such heat, the water jacket 300 is provided to enclose the cylinder body 200.

The water jacket 300 is provided between an inner circumferential surface of the cylinder block 100 and an outer circumferential surface of the cylinder body 200 and forms flow passages through which coolant flows. The water jacket 300 includes an intake side water jacket 310 and an exhaust side water jacket 320.

The intake side water jacket 310 forms, among the flow passages from the block coolant inlet 110 to the first block coolant outlet 120, a flow passage formed at the intake side. The exhaust side water jacket 320 forms, among the flow passages from the block coolant inlet 110 to the first block coolant outlet 120, a flow passage formed at the exhaust side. The exhaust side water jacket 320 includes an exhaust side upper flow passage 321 which is a flow passage formed at the exhaust side and fluidically-communicates with the second block coolant outlet 130, and an exhaust side lower flow passage 322 which is a flow passage formed at the exhaust side and fluidically-communicates with the first block coolant outlet 120.

The block insert 400 is disposed in the water jacket 300 and functions to guide the flow of coolant. The water jacket 400 includes an intake side block insert 410 and an exhaust side block insert 420. The intake side block insert 410 is disposed in the intake side water jacket 310 and functions to increase the flow rate of the exhaust side water jacket 320.

As will be described below, the exhaust side block insert 420 divides the exhaust side water jacket 320 into the exhaust side upper flow passage 321 and the exhaust side lower flow passage 322. That is, the exhaust side block insert 420 functions as a resistance part in the exhaust side water jacket 320. There is high probability that a large amount of coolant passes through the intake side water jacket 310 compared to that of the exhaust side water jacket 320. However, during the operation of the engine, a larger amount of coolant is required for the exhaust side at which high-temperature combustion gas is exhausted. For this, the intake side block insert 410 functioning as a resistance part is installed to increase the flow rate of coolant in the exhaust side water jacket 320. In this regard, a degree to which the flow rate of coolant in the exhaust side water jacket 320 is increased may be set depending on the intention of the designer. That is, in consideration of the optimum efficiency of cooling the engine, an increase in fuel efficiency during a cold start, and so forth, the degree to which the flow rate of coolant in the exhaust side water jacket 320 is increased can be set.

The intake side block insert 410 includes: a plurality of flow resistance portions 411 which are formed such that inner surfaces thereof come into contact with the respective siamese portions 220 of the cylinder body 200; insert supports 412 which protrude upward from upper ends of the respective flow resistance portions 411; and a bridge 413 which couples the flow resistance portions 411 to each other.

The exhaust side block insert 420 is disposed in the exhaust side water jacket 320 and functions to divide the exhaust side water jacket 320 into the exhaust side upper flow passage 321 and the exhaust side lower flow passage 322. As stated above, to prevent knocking and a crack in the cylinder block, there is a need for cooling the exhaust side upper portion of the cylinder block 100 which enters a high-temperature state during the operation of the engine. Furthermore, to achieve rapid warm up during a cold start and thereby enhance start-up performance and fuel efficiency, there is a need to interrupt cooling for portions (that is, an exhaust side lower portion and an exhaust side portion) other than the exhaust side upper portion of the cylinder block 100 during the cold start.

Therefore, there is a need for separately cooling the exhaust side upper portion of the cylinder block 100 and the portions (that is, the exhaust side lower portion and the intake side portion) other than the exhaust side upper portion. For this, the exhaust side block insert 420 is disposed in the exhaust side water jacket 320, thus dividing the exhaust side water jacket 320 into the exhaust side upper flow passage 321 and the exhaust side lower flow passage 322.

The exhaust side block insert 420 includes a body part 421 which comes into contact with an outer surface of the exhaust side water jacket 320, and a gasket 422 which perpendicularly protrudes from an inner surface of the body part 421 and comes into an inner surface of the exhaust side water jacket 320 to divide the exhaust side water jacket 320 into the exhaust side upper flow passage 321 and the exhaust side lower flow passage 322 The body part 421 has a through hole 421-1, which is formed in the body part 421 above the gasket 422, and which fluidically-communicates with the second block coolant outlet 130.

Therefore, the coolant flow passage formed to cool the cylinder block 100 is roughly divided into two circuits by the exhaust block insert 420. Of the two circuits, the circuit for cooling the portions (that is, the exhaust side lower portion and the intake side portion) other than the exhaust side upper portion of the cylinder block 100 is a first circuit (including the intake side water jacket 310 and the exhaust side lower flow passage 322) along which coolant drawn from the block coolant inlet 110 flows to be discharged to the first block coolant outlet 120. Furthermore, of the two circuits, the circuit for cooling the exhaust side upper portion of the cylinder block 100 is a second circuit (including the exhaust side upper flow passage 321) along which coolant drawn from the block coolant inlet 110 flows to be discharged to the second block coolant outlet 130.

Figure 8:
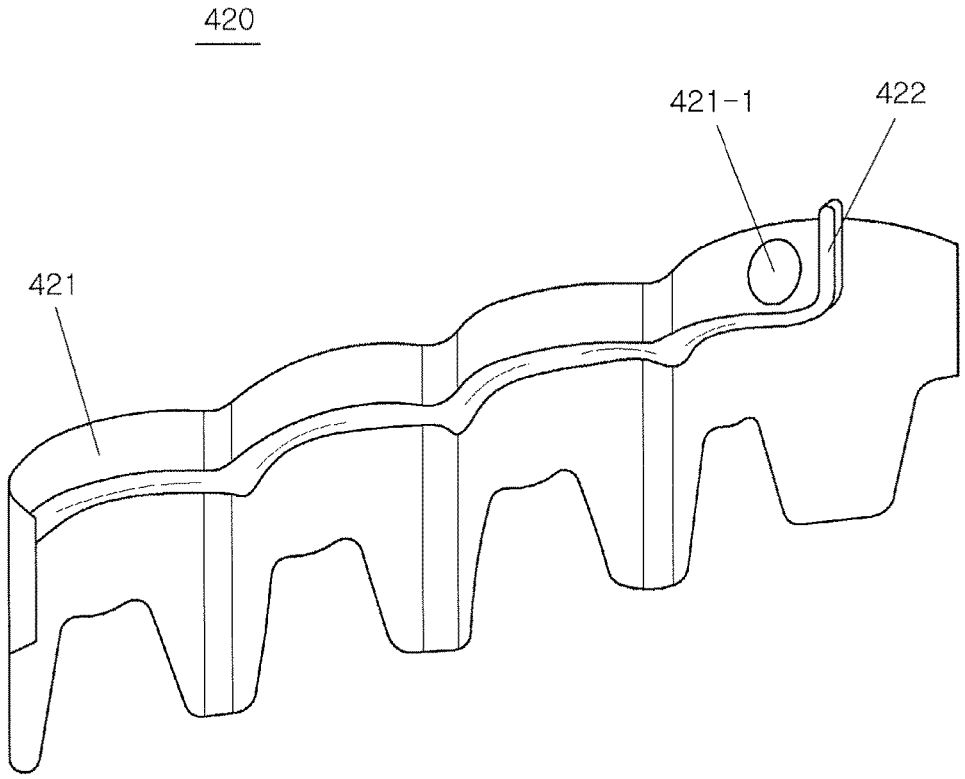
FIG. 8 is a perspective view of an exhaust side block insert according to an exemplary embodiment of the present invention.

FIG. 8 is a perspective view of the exhaust side block insert according to an exemplary embodiment of the present invention. Referring to FIG. 8, the exhaust side block insert according to an exemplary embodiment of the present invention is mounted in the exhaust side water jacket 320 of the water jacket 300 provided between the cylinder block 100 and the cylinder body 200.

The exhaust side block insert 420 includes the body part 421 and the gasket 422. The body part 421 comes into contact with the outer surface of the exhaust side water jacket 320. The gasket 422 perpendicularly protrudes from the inner surface of the body part 421 and comes into the inner surface of the exhaust side water jacket 320 to divide the exhaust side water jacket 320 into the exhaust side upper flow passage 321 and the exhaust side lower flow passage 322.

The through hole 421-1 is formed in the body part 421. The through hole 421-1 is formed above the gasket 422 and fluidically-communicates with the second block coolant outlet 130 formed in an upper end of the second side of the cylinder block 100.

Figure 9:
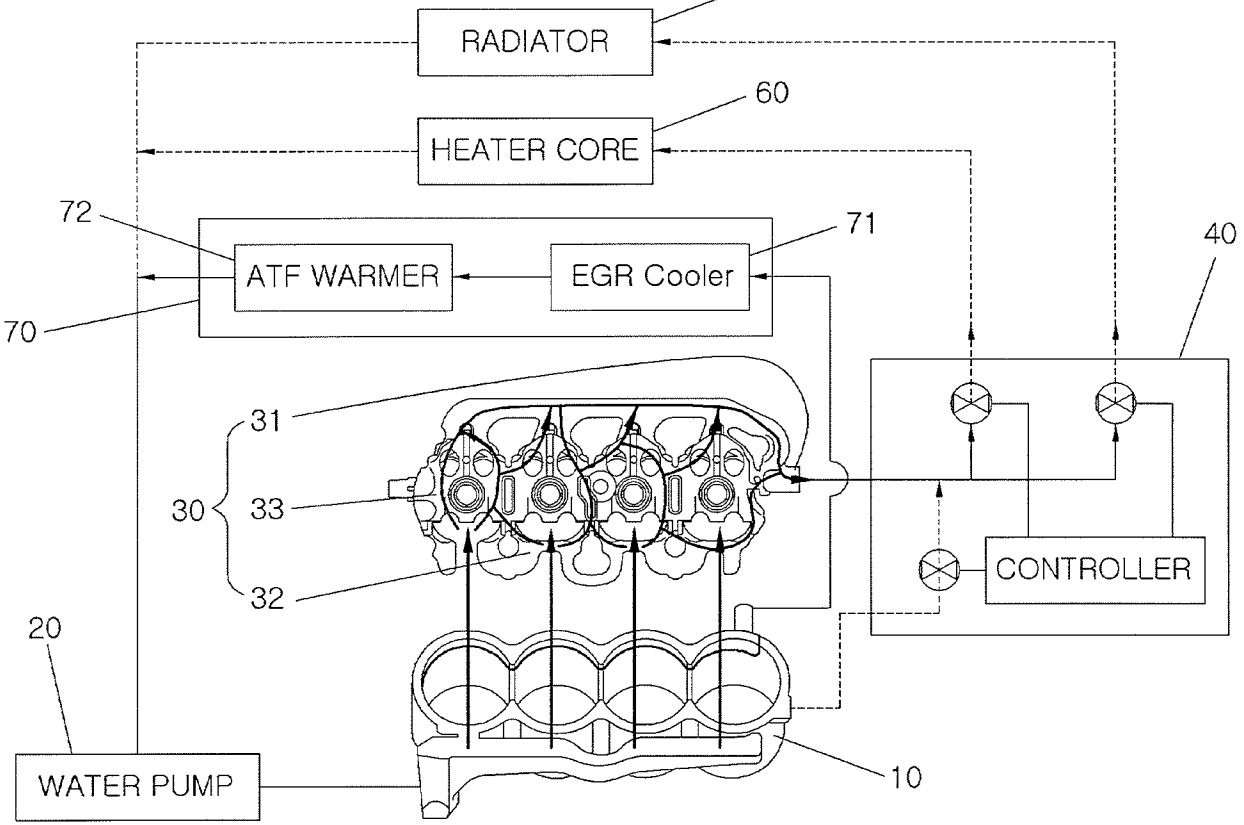
FIG. 9 is a schematic view illustrating a heat management system of the engine according to an exemplary embodiment of the present invention.

FIG. 9 is a schematic view illustrating a heat management system of the engine according to an exemplary embodiment of the present invention. Referring to FIG. 9, the heat management system of the engine according to an exemplary embodiment of the present invention includes the cylinder block assembly 10, the water pump 20, the cylinder head 30, the flow rate control valve 40, a radiator 50, a heater core 60 and the accessory unit 70.

The water pump 20 functions to supply coolant to the block coolant inlet 110 of the cylinder block assembly 10.

The cylinder head 30 is mounted on the upper end of the cylinder block assembly 10. Coolant that has passed through the block gallery 140 is drawn into the cylinder head 30, and the drawn coolant is discharged out of the cylinder head 30 through a cylinder head coolant outlet 31. The cylinder head 30 includes the cylinder head coolant outlet 31, a cylinder head coolant inlet 32, and a cylinder head water jacket 33.

The cylinder head coolant inlet 32 is an inlet through which coolant is drawn from the block gallery 140 into the cylinder head. A plurality of cylinder head coolant inlets 32 may be provided. The cylinder head water jacket 33 is formed such that a plurality of flows of coolant drawn through the cylinder head coolant inlets 32 form cross flows parallel to each other and thus cool respective combustion chambers. The cross flows are a plurality of flows formed in a direction perpendicular to the parallel flows of FIG. 1 and uniformly cool the respective cylinders, thus enhancing the efficiency of cooling the engine. The cylinder head coolant outlet 31 is a passage through which coolant that has passed through the cylinder head water jacket 33 is discharged out of the cylinder head. The cylinder head coolant outlet 31 fluidically-communicates with the flow rate control valve 40.

A first side of the flow rate control valve 40 fluidically-communicates with the cylinder head coolant outlet 31 and the first block coolant outlet 120. The flow rate control valve 40 can individually interrupt the communication with the first block coolant outlet 120. A second side of the flow rate control valve 40 fluidically-communicates with the radiator 50 and the heater core 60. The communication with the radiator 50 and the communication with the heater core 60 is/are individually interrupted by the flow rate control valve 40.

In addition, the accessory unit 70 continuously fluidically-communicates with the second block coolant outlet 130. The accessory unit 70 may be an assembly in which an Exhaust Gas Recirculation (EGR) cooler 71 and an Automatic Transmission Fluid (ATF) warmer 72 are disposed in series or parallel to each other. However, the configuration of the accessory unit 70 is not limited to this, and it may further include other components depending on the intention of the designer.

Furthermore, the water pump 20 fluidically-communicates with the radiator 50, the heater core 60 and the accessory unit 70. Coolant that is discharged from the radiator 50, the heater core 60 or the accessory unit 70 is drawn into the water pump 20 again.

Hereinbelow, the operation of the flow rate control valve 40 and the related operation of the heat management system of the engine will be described in detail. A line that fluidically-communicates the second block coolant outlet 130 with the accessory unit 70 is continuously in an open state. Therefore, coolant discharged from the second block coolant outlet 130 passes through the accessory unit 70 and then returns to the water pump 20. Coolant that has been compressed by the water pump 20 is supplied to the cylinder block assembly 10, more particularly, through the block coolant inlet 110, and then is discharged from the cylinder block assembly 10 through the second block coolant outlet 130 via the exhaust side upper flow passage 321.

Therefore, the circuit for cooling the exhaust side upper portion of the cylinder block 100 is continuously in a state of cooling during the operation of the engine (that is, during the operation of the water pump), thereby preventing knocking or a crack in the cylinder block.

Unlike this, the flow rate control valve 40 may include a controller which controls three valves and opening and closing of the valves. Furthermore, a line that fluidically-communicates the first block coolant outlet 120 with the flow rate control valve 40 is controlled to be opened or closed by one of the valves.

In more detail, while warming up the coolant, the flow rate control valve 40 interrupts communication with the first block coolant outlet 120. In other words, during a cold start, the corresponding valve is closed so that the circuit for cooling the portions (that is, the exhaust side lower portion and the intake side portion) other than the exhaust side upper portion of the cylinder block 100 is closed. Accordingly, during the cold start, rapid warm up is achieved, whereby the start performance and fuel efficiency can be enhanced.

When the engine is not under cold start conditions, the corresponding valve opens. In this case, when the valve related to the radiator 50 which will be described later herein is in an open state, high-temperature coolant discharged from the first block coolant outlet 120 passes through the flow rate control valve 40 and then is cooled by the radiator 50. Subsequently, the coolant that is drawn into the water pump 20 again is supplied to the block coolant inlet 110, and then is discharged from the first block coolant outlet 120 via the exhaust side lower flow passage 322 and the intake side water jacket 310.

Lines that respectively fluidically-communicate the radiator 50 and the heater core 60 with the flow rate control valve 40 are also controlled to be opened or closed by the other two of the valves. Therefore, at an initial stage of the cold start, these two valves are also closed so that the flow passage for cooling the cylinder head 30 is also closed. Accordingly, rapid warm up can be achieved by heat generated by the operation of the engine, whereby the start performance and the fuel efficiency can be enhanced.

Thereafter, while the coolant is cooled, the flow rate control valve 40 opens both communication with the first block coolant outlet 120 and communication with the radiator 50. That is, when there is a need for cooling the cylinder head 30, the valve pertaining to the radiator 50 opens to cool heated coolant. Then, high-temperature coolant discharged from the cylinder head coolant outlet 31 passes through the flow rate control valve 40 and is cooled by the radiator 50. Subsequently, the coolant that is drawn into the water pump 20 again is supplied to the block coolant inlet 110 and the block gallery 140, and then is discharged from the first block coolant outlet 120 via the cylinder head coolant inlet 32 and the cylinder head water jacket 33.

In the case where there is a need for heating the passenger compartment of the vehicle, the valve pertaining to the heater core 60 opens, so heat of the coolant may be transferred to the passenger compartment of the vehicle. In this case, the only difference in the coolant flow passage is that the coolant circulates through the flow passage pertaining to the heater core 60 in lieu of the radiator 50.

The valve pertaining to the radiator 50 and the valve pertaining to the heater core 60 may be selectively opened or closed, or opened or closed.

As described above, according to an exemplary embodiment of the present invention, an exhaust side upper portion of a cylinder block can continuously be cooled, whereby knocking or a crack in the cylinder block can be prevented.

Furthermore, cross flows are induced in a cylinder head, whereby cylinders of a cylinder body can be uniformly cooled. Hence, efficiency of cooling the engine can be enhanced.

Moreover, during a cold start, except for the exhaust side upper portion, cooling for the other portions (that is, an exhaust side lower portion and an intake side portion) of the cylinder block is interrupted. Accordingly, rapid warm up during the cold start can be achieved, whereby the start performance and the fuel efficiency can be enhanced.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder block assembly comprising:

a cylinder block;

a cylinder body disposed in the cylinder block, with a plurality of cylinder bores formed in the cylinder body;

a water jacket, which is formed between an inner circumferential surface of the cylinder block and an outer circumferential surface of the cylinder body, and through which coolant flows; and a block insert disposed in the water jacket and configured to guide a flow of the coolant, wherein the cylinder block comprises:

a first block coolant outlet, which is formed in a second side surface of the cylinder block, and through which the coolant in the water jacket is discharged;

a second block coolant outlet, which is formed at a second side in a surface of an exhaust side of the cylinder block, and through which the coolant in the water jacket is discharged, and a block coolant inlet which is formed at a first side in a surface of an intake side of the cylinder block, and into which coolant is drawn from a water pump, the block coolant inlet being configured to supply the drawn coolant into the water jacket, wherein the exhaust side comprises a side at which combustion gas is exhausted out of the cylinder body, and wherein the block insert comprises:

an intake side block insert disposed in an intake side water jacket of the water jacket, and configured to increase a flow rate of an exhaust side water jacket of the water jacket; and an exhaust side block insert separately mounted from the intake side block insert and disposed in an exhaust side water jacket of the water jacket and configured to divide the exhaust side water jacket into an exhaust side upper flow passage and an exhaust side lower flow passage.

2. The cylinder block assembly of claim 1, wherein the intake side comprises a side at which a mixture of fuel and air is drawn into the cylinder body.

3. The cylinder block assembly of claim 1, wherein the cylinder block comprises:

a block gallery diverging from the block coolant inlet and configured to supply, into a cylinder head, coolant drawn into the block coolant inlet, the block gallery making a plurality of flows of supplied coolant parallel to each other.

4. The cylinder block assembly of claim 3, wherein the water jacket comprises:

the intake side water jacket comprising, of flow passages formed from the block coolant inlet to the first block coolant outlet, a flow passage formed in the intake side; and the exhaust side water jacket comprising, of the flow passages formed from the block coolant inlet to the first block coolant outlet, a flow passage formed in the exhaust side.

5. The cylinder block assembly of claim 4, wherein the exhaust side water jacket comprises:

the exhaust side upper flow passage provided as a flow passage formed at the exhaust side, and communicating with the second block coolant outlet; and the exhaust side lower flow passage provided as a flow passage formed at the exhaust side, and communicating with the first block coolant outlet.

6. The cylinder block assembly of claim 1, wherein the intake side block insert includes:

a plurality of flow resistance portions formed such that inner surfaces thereof come into contact with respective siamese portions of the cylinder body;

insert supports protruding upward from upper ends of the respective flow resistance portions; and a bridge coupling the plurality of flow resistance portions to each other.

7. The cylinder block assembly of claim 1, wherein the exhaust side block insert includes:

a body part coming into contact with an outer surface of the exhaust side water jacket; and a gasket protruding perpendicularly from an inner surface of the body part and coming into an inner surface of the exhaust side water jacket so that the exhaust side water jacket is partitioned into the exhaust side upper flow passage and the exhaust side lower flow passage by the gasket.

8. The cylinder block assembly of claim 7, wherein the body part includes:

a through hole formed above the gasket and communicating with the second block coolant outlet.

9. The heat management system of the engine, including:

the cylinder block assembly of claim 8, a water pump configured to supply coolant to a block coolant inlet of the cylinder block assembly;

a cylinder head mounted on an upper end of the cylinder block assembly and configured such that coolant that has passed through the block gallery is drawn into the cylinder head, the cylinder head including a cylinder head coolant outlet through which the coolant is discharged out of the cylinder head; and a flow rate control valve communicating at a first side thereof with the cylinder head coolant outlet and the first block coolant outlet, and configured to individually interrupt the communication with the first block coolant outlet.

10. The heat management system of claim 9, further including:

a radiator and a heater core that fluidically-communicate with a second side of the flow rate control valve, wherein the communication with the each of the radiator and the heater core is individually interrupted by the flow rate control valve.

11. The heat management system of claim 10, further including:

an accessory unit communicating with the second block coolant outlet.

12. The heat management system of claim 11, wherein the water pump fluidically-communicates with the radiator, the heater core and the accessory unit, and wherein coolant discharged from the radiator, the heater core or the accessory unit is drawn into the water pump again.

13. The heat management system of claim 9, wherein the cylinder head includes:

a plurality of cylinder head coolant inlets into which coolant is drawn from the block gallery;

a cylinder head water jacket formed such that a plurality of flows of coolant drawn through the cylinder head coolant inlets form cross flows parallel to each other and cool respective combustion chambers; and a cylinder head coolant outlet through which coolant that may have passed through the cylinder head water jacket is discharged.

14. The heat management system of claim 11, wherein the accessory unit includes:

an assembly including an Exhaust Gas Recirculation (EGR) cooler and an Automatic Transmission Fluid (ATF) warmer that are disposed in series or parallel to each other.

15. The heat management system of claim 9, wherein, while the coolant is warmed up, the flow rate control valve interrupts the communication with the first block coolant outlet.

16. The heat management system of claim 10, wherein, while the coolant is cooled, the flow rate control valve opens the communication with the first block coolant outlet and the communication with the radiator.

* * * * *